US009836959B1

(12) United States Patent
Johnson et al.

(10) Patent No.: US 9,836,959 B1
(45) Date of Patent: Dec. 5, 2017

(54) PEDESTRIAN SAFETY SYSTEM AND METHOD FOR A RESTAURANT WITH A DRIVE-THROUGH LANE

(71) Applicants: Brad Johnson, Saluda, NC (US); Lori Johnson, Saluda, NC (US)

(72) Inventors: Brad Johnson, Saluda, NC (US); Lori Johnson, Saluda, NC (US)

( * ) Notice: Subject to any disclaimer, the term of this patent is extended or adjusted under 35 U.S.C. 154(b) by 0 days.

(21) Appl. No.: 15/463,585

(22) Filed: Mar. 20, 2017

(51) Int. Cl.
*G08B 21/00* (2006.01)
*G08G 1/005* (2006.01)
*G08G 1/16* (2006.01)

(52) U.S. Cl.
CPC ..... *G08G 1/005* (2013.01); *G08G 1/166* (2013.01)

(58) Field of Classification Search
CPC ..... G08G 1/005
USPC ..... 340/435, 436, 933, 944, 537.1
See application file for complete search history.

(56) References Cited

U.S. PATENT DOCUMENTS

| | | | |
|---|---|---|---|
| 6,292,100 | B1 | 9/2001 | Dowling |
| 2007/0024433 | A1 | 2/2007 | Garner |
| 2008/0022596 | A1 | 1/2008 | Boerger et al. |

*Primary Examiner* — Jeffery Hofsass
(74) *Attorney, Agent, or Firm* — Dale J. Ream

(57) ABSTRACT

A pedestrian safety system for a restaurant having a drive-through lane for an automobile, a pickup window, and a pedestrian door. The system includes lane sensors proximate the pickup window that generate lane data indicate of the proximity and motion of an automobile. A controller is in data communication with the lane sensors and programmed to determine proximity and motion status data regarding an automobile in the drive through lane. A pedestrian visual alert member is positioned proximate the pedestrian door of the restaurant and includes Stop, Go, and Caution indicator lamps. An appropriate lamp is energized by the controller depending if the lane sensors detect an automobile moving downstream in the drive-through lane, stopped at the pick-up window, or the lane is clear. The system may also include pedestrian sensors inside the restaurant and a lane visual alert member having indicator lamps to indicate a status of pedestrian traffic.

22 Claims, 4 Drawing Sheets

PEDESTRIAN SAFETY SYSTEM AND METHOD FOR A RESTAURANT WITH A DRIVE-THROUGH LANE

BACKGROUND OF THE INVENTION

This invention relates generally to pedestrian safety systems and, more particularly, to a method and system for the safety of pedestrians at a restaurant having a drive through lane to facilitate picking up food and beverage items and that intersects with the path of pedestrians entering and exiting the restaurant.

Fast food restaurants with drive through lanes have been around for decades for the convenience of busy people who would rather eat while driving or riding in the car than to sit down for a meal. To accommodate parking on at least two sides of a respective restaurant, the drive through lane intersects the path of restaurant patrons on at least one side. So, for a few seconds a pedestrian walks across the path of automobiles having just picked up their order. Crossing a parking lot or drive through lane is usually not a problem; however, when a customer exits a door to the restaurant immediately into the drive through lane, an accident may occur. If either a customer or a driver is not diligent before advancing forward, a collision between the car and the patron is inevitable.

Various devices and systems have been proposed for alerting pedestrians regarding the presence of another person or vehicle on an opposite side of a door or passageway. Although presumably effective for their intended purposes, the existing systems have not addressed the unique situation presented by the intersection of a pedestrian door with a drive through lane of a fast food restaurant, namely, to detect and report motion at two separate locations as indicative of a potential collision at a third location (e.g. at an intersection of the drive through lane and an area just outside the pedestrian door).

Therefore, it would be desirable to have a pedestrian safety system and method for detecting the motion of an automobile in a drive through lane outside the restaurant and then activating a pedestrian visual alert device. Similarly, it would be desirable to have a pedestrian safety system and method for detecting the motion of a pedestrian inside a restaurant who is walking toward an exit door and then activating a drive through lane visual alert device. In addition, it would be desirable to have a pedestrian safety system and method for alerting when there is no chance of collision, when there is a cautionary risk of a future collision (based on movement at one or both locations), and when a collision is likely.

SUMMARY OF THE INVENTION

A system and method of pedestrian safety for implementation at a restaurant having a drive-through lane for an automobile, a pickup window situated along the drive-through lane, and a pedestrian door downstream of the pickup window. The system includes a plurality of lane sensors positioned proximate the pickup window and configured to generate lane data, the plurality of lane sensors include an upstream lane sensor adjacent an upstream end of the pickup window and at least a pair of downstream lane sensors arranged in a series downstream of the pickup window. A controller is in data communication with the plurality of lane sensors and programmed to determine proximity and motion status data regarding an automobile in the drive through lane. A pedestrian visual alert member is positioned proximate the pedestrian door of the restaurant and includes Stop, Go, and Caution indicator lamps. An appropriate lamp is energized depending if the lane sensors detect an automobile moving downstream in the drive-through lane, stopped at the pick-up window, or the lane is clear.

Therefore, a general object of this invention is to provide a pedestrian safety system and method for detecting movement in two separate locations in order to alert and protect against a collision in yet another location.

Another object of this invention is to provide a pedestrian safety system, as aforesaid, having a plurality of drive through lane sensors configured to detect a position and motion of an automobile in the lane relative to a pedestrian door of the restaurant.

Still another object of this invention is to provide a pedestrian safety system, as aforesaid, having a plurality of pedestrian sensors located inside the restaurant and configured to determine when a customer is moving toward an exit door.

Yet another object of this invention is to provide a pedestrian safety system, as aforesaid, having visual alert members in view of the exit door and the drive through lane for alerting an exiting patron and driver when a collision is likely and extra diligence or attention is needed.

A further object of this invention is to provide a pedestrian safety system, as aforesaid, that is intuitive to drivers and patrons leaving the restaurant regarding the potential of encountering the other, respectively.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
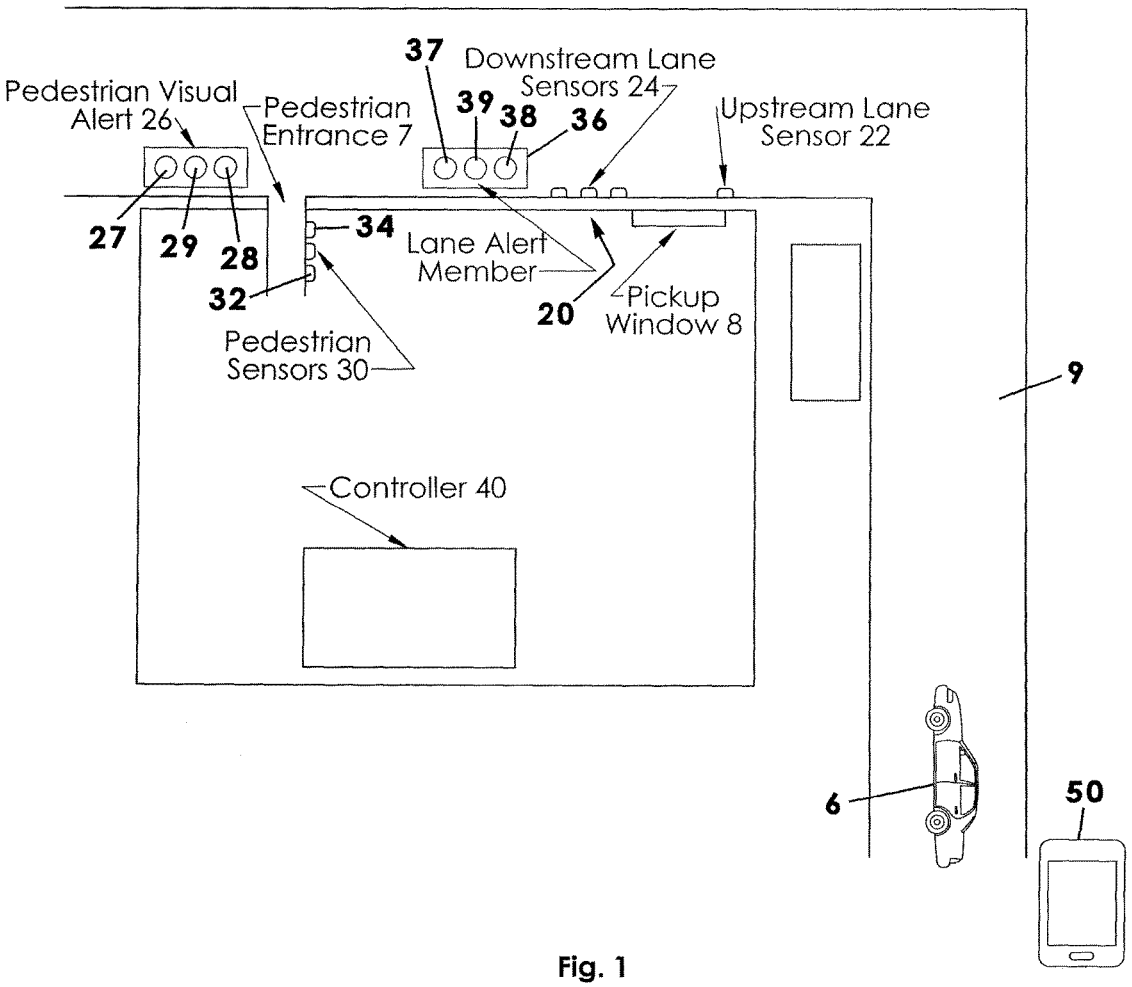
FIG. 1 is a diagrammatic illustration of a pedestrian safety system according to a preferred embodiment of the present invention.

A pedestrian safety system and method according to a preferred embodiment of the present invention will now be described in detail with reference to FIGS. 1 to 4 of the accompanying drawings. The pedestrian safety system 10 includes a plurality of lane sensors 20, a plurality of pedestrian sensors 30, a controller 40, a lane visual alert member 26, and a pedestrian visual alert member 36.

The pedestrian safety system 10 is designed to keep pedestrians safe in and around a restaurant of a type having a drive-through lane 9, a pickup window 8, and a pedestrian door 7 through which consumers may enter and exit the restaurant. FIG. 1 is a diagrammatic depiction of an exemplary embodiment of the present invention, illustrating a fast food restaurant having an L-shaped drive through lane 9. An automobile 6 on a reduced scale is shown to illustrate the direction and pathway along the drive through lane 9 that is intended for automobiles in picking food and beverage items from the pickup window 8.

The pedestrian safety system 10 includes a plurality of lane sensors 20 strategically positioned along the drive through lane 9 so that the presence of an automobile and the movement thereof may be detected. More particularly, the plurality of lane sensors 20 includes an upstream lane sensor 22 that may be a proximity sensor configured to sense the presence of the automobile 6. Preferably, the upstream lane sensor 22 is mounted to an exterior wall of the restaurant building adjacent to the pickup window 8, such as on the upstream end of the pickup window 8. In operation, the upstream lane sensor 22 is capable of detecting when an automobile 6 is stopped at the pickup window to receive food items. Alternatively, the upstream lane sensor 22 may be mounted adjacent a pay window in an instance where a window for receiving payment is separate from the pickup window 8.

Further, the plurality of lane sensors 20 may also include at least a pair but preferably three or more downstream lane sensors 24 arranged in series along the drive through lane 9. The downstream lane sensors 24 may be spaced apart from one another downstream of the upstream lane sensor 22 and pickup window 8. The downstream lane sensors 24 may be proximity or motion sensors. As will be further discussed below, the time stamp when each respective downstream lane sensor 24 detects motion or proximity can be used to determine that an automobile is traveling downstream in the drive through lane 9. The plurality of lane sensors 20 generate "lane data" indicative of proximity of an automobile to a respective sensors as well as motion data (i.e. time stamp data as described above).

The pedestrian safety system 10 includes a controller 40 in data communication with the plurality of lane sensors 20. The data communication may be through wires or wireless, including with Bluetooth technology. In an embodiment, the controller 40 may include a transmitter 46 and receiver 48, respectively, for sending and receiving data with the sensors. It is understood that the controller 40 may be an electronics module or circuit board that includes circuitry, a microprocessor 42, a non-volatile memory 44 configured for storing data structures, digital data, and programming instructions for execution by the microprocessor or the like. Execution of programming instructions or the function of actual circuitry will be referred to herein as the controller 40 being "programmed" to analyze data from respective sensors and then to direct predetermined actions be taken as will be described below.

As implied above, the controller 40 receives "lane data" from the upstream lane sensor 22 and at least a pair of downstream lane sensors 24 and is programmed to determine proximity status data and motion status data for each reporting sensor. For instance, the upstream lane sensor 22 is configured to determine if an automobile is stationary and adjacent to the pickup window 8. In other words, the upstream lane sensor 22 is capable of determining that an object indicative of a car is within a predetermined distance of the upstream lane sensor 22. Similarly, the downstream lane sensors 24 are configured to detect if and when an automobile passes thereby. The controller 40, therefore, is programmed to determine a complete understanding (i.e. a "snapshot") of the presence, position, and motion of an automobile 6 relative to the drive through lane 9 upon receiving generated lane data from the plurality of lane sensors 20.

In another aspect, the pedestrian safety system 10 includes a pedestrian visual alert member 26. More particularly, the pedestrian visual alert member 26 may be a pedestrian light tree having at least one, but preferably all, of a Stop 27, Go 28, and Caution 29 indicator lamps. These indicator lamps may be a red light emitting diode (LED), green LED, and yellow LED, respectively. As will be described explicitly below, the controller 40 is programmed to energize respective indicator lamps according the data described above. The pedestrian visual alert member 26 may be positioned either inside or outside of the restaurant proximate or adjacent to the pedestrian door 7. For instance, the pedestrian visual alert member 26 is mounted or positioned where it may be conveniently seen and understood by a consumer who is preparing to or actually exiting through the pedestrian door 7.

Figure 3:
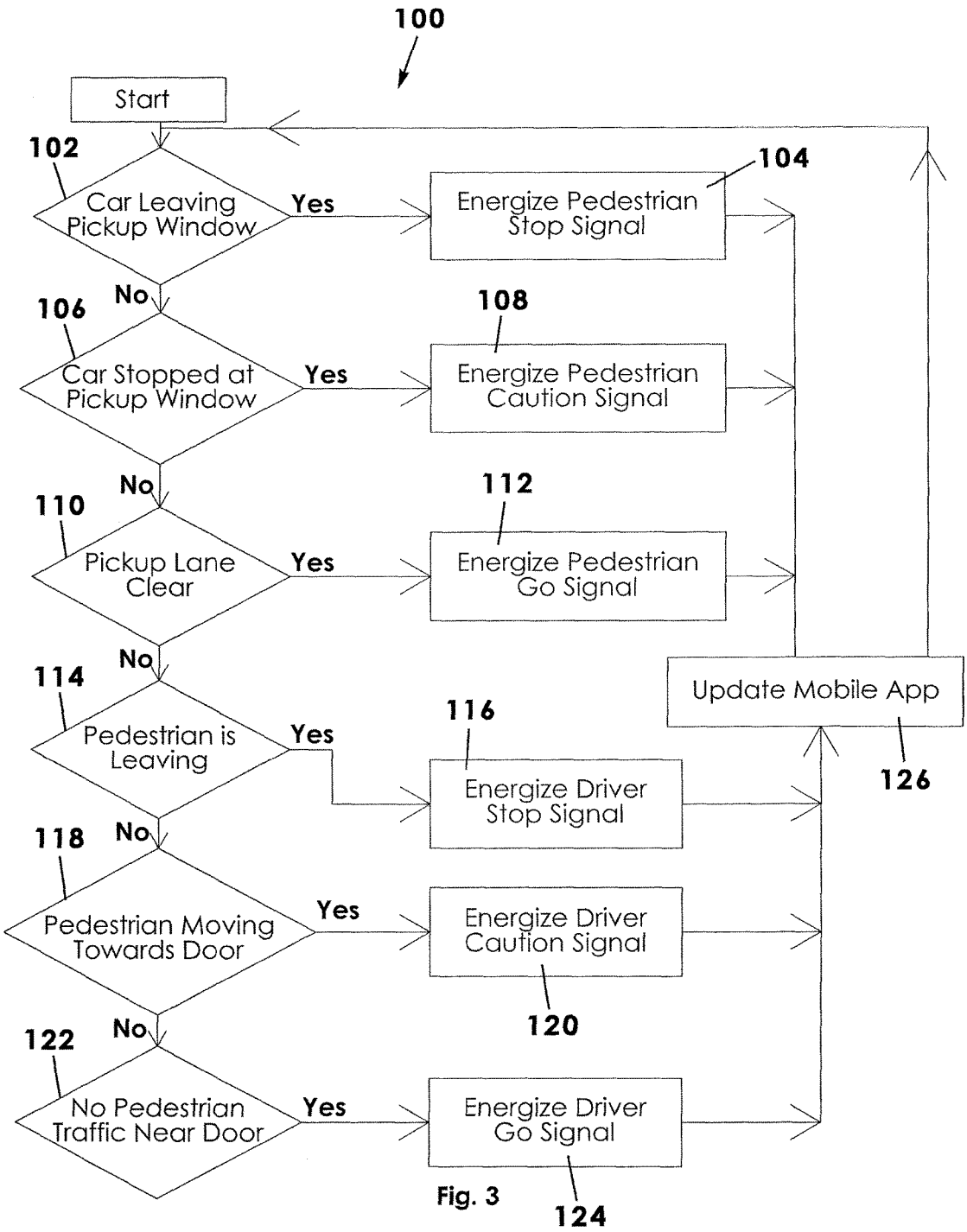
FIG. 3 is a flowchart illustrating the logic of the system.
Figure 4:
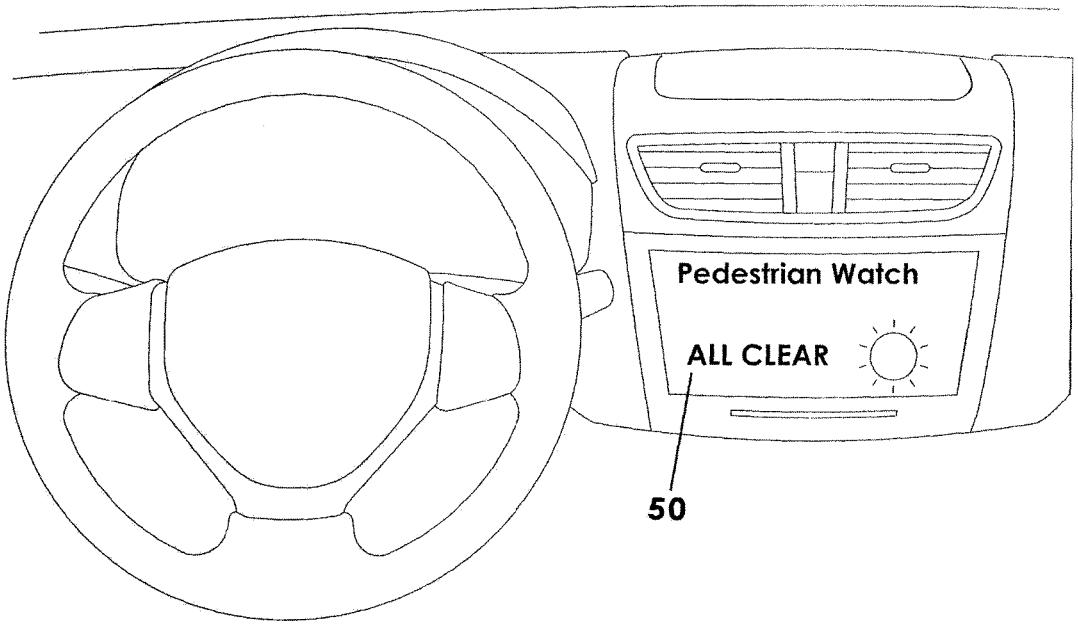
FIG. 4 is a remote monitoring module according to the present invention.

In an embodiment, the pedestrian visual alert member 26 may include only a red "Stop" lamp that is energized to alert a pedestrian that it is not clear to walk across the drive-through lane 9, e.g. an automobile is actively driving downstream across the path of the pedestrian. In a preferred embodiment, however, the pedestrian visual alert member 26 includes all three indicator lamps disclosed above and which are energized under specific conditions. An exemplary method according to the present invention is illustrated in FIG. 3, the steps of which are noted in the description that follows. First, the controller 40 is programmed to energize the Stop indicator lamp 27 (step 104) of the pedestrian visual alert member 26 if, according to the generated lane data of the downstream lane sensors 24, it is determined that an automobile 6 is in motion downstream of the pickup window 8 (step 102). In other words, data gathered by the downstream lane sensors 24 will indicate proximity and downstream motion of an automobile 6 and will cause the controller 40 to actuate the Stop indicator lamp 27 to advise a pedestrian to wait for the automobile 6 to clear before exiting the restaurant through the pedestrian door 7.

Further, the controller 40 is able to determine, based on lane data received from the upstream lane sensor 22, if an automobile is detected proximate the upstream lane sensor 22 (step 106), i.e. detect if an automobile 6 is stopped at the pickup window 8. In that instance, the controller 40 is programmed to energize the Caution indicator lamp 29 (step 108) (i.e. energize the yellow light). In other words, an automobile 6 stopped at the pickup window 8 is not an immediate danger to an exiting pedestrian but will be moving downstream soon.

However, it is recognized that one automobile may be stopped adjacent the upstream lane sensor 22 and pickup window 8 (which is associated with a Caution alert) while another automobile might actually be travelling downstream of the pickup window 8 simultaneously (which would generate a Stop alert). In this circumstance, the controller 40 is programmed to energize only the Stop indicator lamp 27. In other words, detecting the condition of a moving automobile is given priority over detecting a stationary vehicle at the pickup window 8.

Still further, the controller 40 is programmed to determine from the proximity and motion status data determined from the generated lane data if no automobile is detected adjacent the pickup window 8 or in motion downstream thereof (step 110). In other words, the controller 40 is capable of determining that that drive through lane 9 is totally clear. In this instance, the controller 40 is programmed to energize the Go indicator lamp 28 of the pedestrian visual indicator member 26 (step 112), i.e. the green light of the pedestrian visual alert member.

In another aspect, the pedestrian safety system 10 may include a plurality of pedestrian sensors 30 mounted or positioned proximate the pedestrian door 7 of the restaurant. The pedestrian sensors may include a combination of proximity sensors and motion sensors that, individually and together, generate pedestrian traffic data. Again, the position and arrangement of the pedestrian sensors is critical to accurately determining the actions and intensions of a consumer, i.e. is the consumer (a restaurant customer) entering or exiting the pedestrian door 7. More particularly, the plurality of pedestrian sensors 30 may include an upstream lane sensor 22 that may be mounted in a restaurant at a position displaced from the pedestrian door 7 and at least a pair (but preferably three or more) of downstream pedestrian sensors 34 arranged in a spaced apart series downstream of the upstream pedestrian sensor 32. The pedestrian sensors 30 may be in data communication with the controller either through wired or wireless technology.

Generally, the upstream and downstream pedestrian sensors enable the controller 40 to determine proximity and direction of travel status data of a restaurant customer in a manner substantially similar to the determinations of the upstream and downstream lane sensors described above. More particularly, the controller 40 is configured to determine the presence of a customer is within a predetermined distance of the pedestrian door 7. Then, the pedestrian traffic data taken from the downstream pedestrian sensors 34 may be used by the controller 40 to determine that the customer is actively moving toward the pedestrian door 7 in a manner indicative of exiting the restaurant therethrough.

The pedestrian safety system 10 includes a lane visual alert member 36. More particularly, the lane visual alert member 36 may be a lane light tree having at least one, but preferably all, of a Stop 37, Go 38, and Caution 39 indicator lamps. These indicator lamps may be a red light emitting diode (LED), green LED, and yellow LED, respectively. As will be described explicitly below, the controller 40 is programmed to energize respective indicator lamps according the data described above. The lane visual alert member 36 may be positioned along the downstream portion of the drive through lane 9, preferably between the pickup window 8 and the pedestrian door 7. This way, a driver may be alerted that a customer or pedestrian may or may not be exiting the pedestrian door 7. In other words, the lane visual light member 36 is mounted or positioned where it may be conveniently seen and understood by a driver of an automobile 6 traveling downstream along the drive through lane 9.

Using the data and determinations described above, the controller 40 is programmed to energize the Stop indicator lamp 37 of the lane visual alert member 36 (step 114) if it determines from the downstream pedestrian sensors 34 that a customer is moving toward the pedestrian door in a manner indicative of exit therethrough (step 116). Similarly, if the controller 40 determines that a customer is proximate the upstream pedestrian sensor 32 but not necessarily the downstream pedestrian sensors 34 (step 118), the controller 40 is configured to energize the Caution indicator lamp 39 of the lane visual alert member 36 (120). This action would indicate to a driver that a pedestrian is not "imminently" exiting the restaurant but that the pedestrian is in the proximity to do so soon.

However, it is recognized that one customer may be stopped or detected adjacent the upstream pedestrian sensor 32 (which is associated with a Caution alert) while another customer might actually be travelling toward the pedestrian door 7 simultaneously (which would generate a Stop alert). In this circumstance, the controller 40 is programmed to energize only the Stop indicator lamp 37. In other words, detecting the condition of an exiting pedestrian is given priority over detecting merely a proximate customer displaced from the pedestrian door 7.

Still further, the controller 40 is programmed to determine from the proximity and motion status data determined from the generated pedestrian data, if no pedestrian (customer) is detected proximate the upstream pedestrian sensor 32 or in motion downstream thereof (step 122). In other words, the controller 40 is capable of determining that that no customer is ready or preparing to exit the restaurant. In this instance, the controller 40 is programmed to energize the Go indicator lamp 38 of the lane visual alert member 36, i.e. the green light of the lane light tree (step 124).

It is understood that the pedestrian safety system 10 may include any combination of the plurality of lane sensors 20 and plurality of pedestrian sensors 30, and associated visual alert members. The combined system operates in substantially the manner as described above. In the description above, it is understood that detecting movement of automobiles along a drive through lane is a "first location" and that detecting movement of patrons inside of the restaurant is a "second location" and that the intersection between the drive through lane and an area adjacent an exterior of a restaurant pedestrian door is a "third location." Therefore, detecting movement in the first location and the second location enables the controller to "predict" a potential collision between an exiting patron and an automobile in downstream movement along the drive through lane, i.e. at a "third location."

Figure 2:
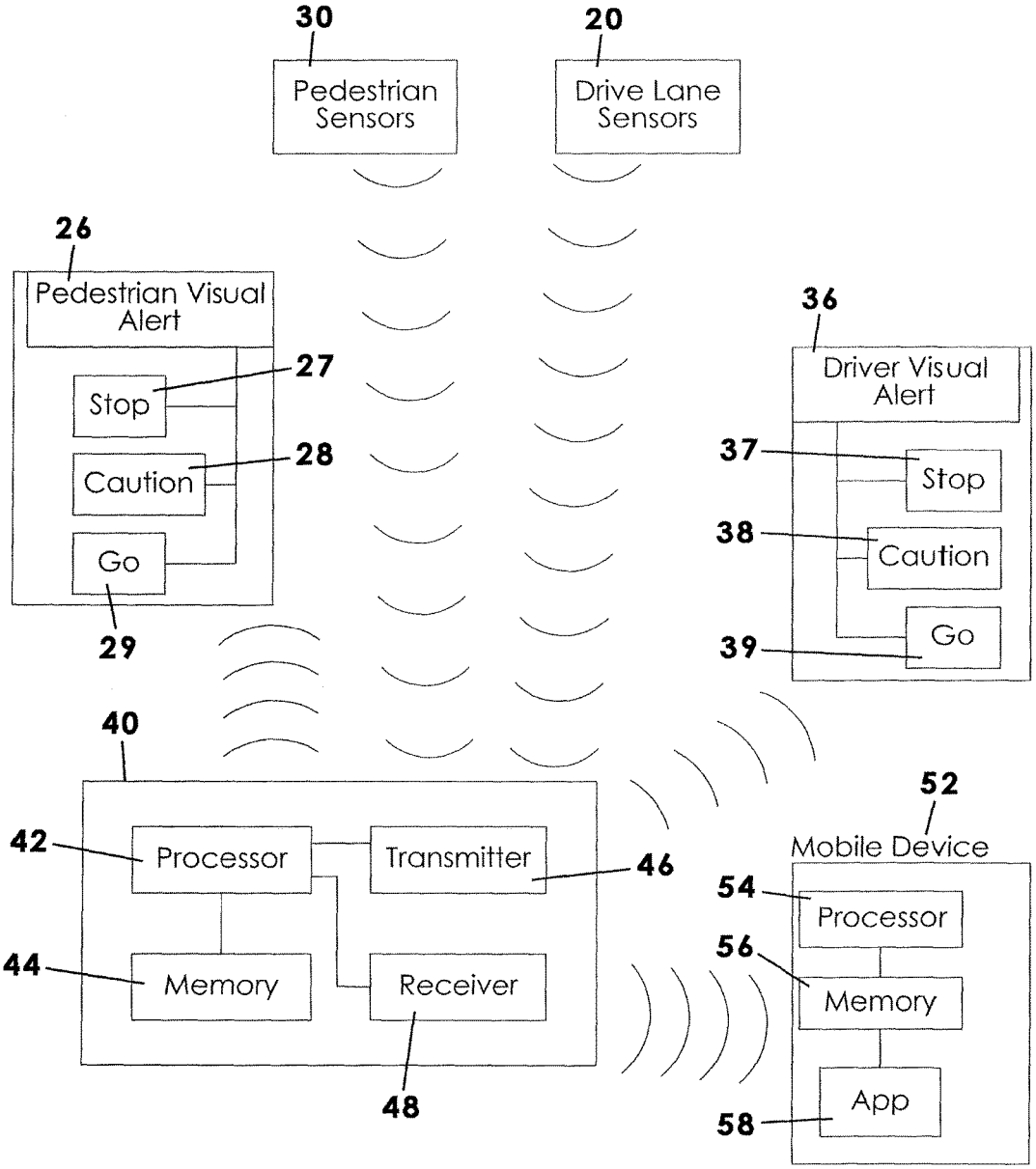
FIG. 2 is a block diagram of the pedestrian safety system as in FIG. 1.

In another aspect, the pedestrian safety system 10 may include a monitoring module 50 remote from the controller 40 configured to run on a mobile electronic device having a receiver and a display, such as on a mobile phone, tablet, laptop computer or any electronics device having internet access. In an embodiment, the monitoring module 50 may be integrated with the electronics module of an automobile (FIG. 3). The monitoring module 50 may be a software application 58 stored in memory 56 and running on a processor 54 of the respective mobile device 52 (FIG. 2). The monitoring module 50 via the software application 58 may be updated each time the lane sensors 20 or pedestrian sensors 30 generate new data set (step 126).

It is understood that while certain forms of this invention have been illustrated and described, it is not limited thereto except insofar as such limitations are included in the following claims and allowable functional equivalents thereof.

The invention claimed is:

1. A pedestrian safety system for a restaurant having a drive-through lane for an automobile, a pickup window situated along the drive-through lane, and a pedestrian door downstream of the pickup window, comprising:

a plurality of lane sensors positioned proximate the pickup window and configured to generate lane data, said plurality of lane sensors include an upstream lane sensor adjacent an upstream end of the pickup window and at least a pair of downstream lane sensors arranged in a series downstream of the pickup window;

a controller in data communication with said plurality of lane sensors and programmed to determine, using said generated lane data, proximity status data and motion status data regarding an automobile in the drive through lane;

a pedestrian visual alert member positioned proximate the pedestrian door of the restaurant and having at least one of a Stop, Go, or Caution indicator lamp;

wherein said controller is programmed to energize respective indicator lamps of said pedestrian visual alert member according to said proximity status data and said motion status data.

2. The pedestrian safety system as in claim 1, wherein:

said controller is programmed to determine, using data from said pair of downstream lane sensors, if an automobile is in motion downstream of the pickup window; and said controller is programmed to energize said Stop indicator lamp of said pedestrian visual alert member when said controller has determined that the automobile is in motion downstream of the pickup window.

3. The pedestrian safety system as in claim 2, wherein:

said controller is programmed to determine, using data from said upstream lane sensor, if an automobile is stopped adjacent said upstream lane sensor; and said controller is programmed to energize said Caution indicator lamp of said pedestrian visual alert member when said controller has determined that the automobile is stopped adjacent said upstream lane sensor.

4. The pedestrian safety system as in claim 3, wherein:

said controller is programmed to determine, using data from said upstream lane sensor and said pair of downstream lane sensors, if an automobile is stopped adjacent said upstream lane sensor and if another automobile is in motion downstream of said upstream sensor; and said controller is programmed to energize only said Stop indicator lamp of said pedestrian visual alert member when said controller has determined that an automobile is stopped adjacent said upstream lane sensor and that another automobile is in motion downstream of said upstream sensor.

5. The pedestrian safety system as in claim 3, wherein:

said controller is programmed to determine, using data from said upstream lane sensor and said pair of downstream lane sensors, if an automobile is stopped adjacent said upstream lane sensor and if another automobile is in motion downstream of said upstream sensor; and said controller is programmed to energize said Go indicator lamp of said pedestrian visual alert member when said controller has determined that no automobile is detected adjacent said upstream lane sensor and that no automobile is in motion downstream of said upstream sensor.

6. The pedestrian safety system as in claim 1, wherein:

said controller is programmed to determine, using data from said upstream lane sensor and said pair of downstream lane sensors, if an automobile is stopped adjacent said upstream lane sensor and if another automobile is in motion downstream of said upstream sensor; and said controller is programmed to energize said Go indicator lamp of said pedestrian visual alert member when said controller has determined that no automobile is detected adjacent said upstream lane sensor and that no automobile is in motion downstream of said upstream sensor.

7. The pedestrian safety system as in claim 1, further comprising:

a plurality of pedestrian sensors positioned proximate the pedestrian door, said plurality of pedestrian sensors including a series of motion sensors configured to generate pedestrian traffic data;

a lane visual alert member positioned in the drive through lane downstream from the pickup window, said lane visual alert member having at least one of a Stop, Go, or Caution indicator lamp;

wherein said controller is in data communication with said plurality of pedestrian sensors and programmed to determine, using said generated pedestrian data, a proximity and a direction of travel of a pedestrian;

wherein said controller is programmed to energize respective indicator lamps of said lane visual alert member according to said proximity status data and said direction of travel status data.

8. The pedestrian safety system as in claim 7, wherein said plurality of pedestrian sensors include an upstream lane sensor displaced from the pedestrian door and at least a pair of downstream pedestrian sensors arranged in a series downstream of the upstream pedestrian sensor.

9. The pedestrian safety system as in claim 8, wherein:

said controller is programmed to determine, using data from said pair of downstream pedestrian sensors, if a pedestrian is in motion indicative of exiting the pedestrian door; and said controller is programmed to energize said Stop indicator lamp of said lane visual alert member when said controller has determined that the pedestrian is in motion indicative of exiting the pedestrian door.

10. The pedestrian safety system as in claim 9, wherein:

said controller is programmed to determine, using data from said upstream pedestrian sensor, if a pedestrian is proximate said upstream pedestrian sensor; and said controller is programmed to energize said Caution indicator lamp of said lane visual alert member when said controller has determined that the pedestrian is adjacent said upstream pedestrian sensor.

11. The pedestrian safety system as in claim 10, wherein:

said controller is programmed to determine, using data from said upstream pedestrian sensor and said pair of downstream pedestrian sensors, if an pedestrian is adjacent said upstream pedestrian sensor and if another pedestrian is in motion downstream of said upstream pedestrian sensor; and controller is programmed to energize only said Stop indicator lamp of said lane visual alert member when said controller has determined that a pedestrian is adjacent said upstream lane sensor and that another pedestrian is in motion downstream of said upstream pedestrian sensor indicative of exiting the pedestrian door.

12. The pedestrian safety system as in claim 8, wherein:

said controller is programmed to determine, using data from said upstream pedestrian sensor and said pair of downstream pedestrian sensors, if an pedestrian is adjacent said upstream pedestrian sensor and if another pedestrian is in motion downstream of said upstream pedestrian sensor; and said controller is programmed to energize said Go indicator lamp of said lane visual alert member when said controller has determined that no pedestrian is detected adjacent said upstream pedestrian sensor and that no pedestrian is in motion downstream of said upstream sensor.

13. A pedestrian safety system for a restaurant having a drive-through lane for an automobile, a pickup window situated along the drive-through lane, and a pedestrian door downstream of the pickup window, comprising:

a plurality of lane sensors positioned proximate the pickup window and configured to generate lane data, said plurality of lane sensors include an upstream lane sensor adjacent an upstream end of the pickup window and at least a pair of downstream lane sensors arranged in a series downstream of the pickup window;

a plurality of pedestrian sensors positioned proximate the pedestrian door, said plurality of pedestrian sensors including a series of motion sensors configured to generate pedestrian traffic data;

a controller in data communication with said plurality of lane sensors and with said plurality of pedestrian sensors, said controller being programmed to determine, using said generated lane data, proximity status data and motion status data regarding an automobile in the drive through lane and programmed to determine, using said generated pedestrian data, a proximity and a direction of travel of a pedestrian;

a pedestrian visual alert member positioned proximate the pedestrian door of the restaurant and having at least one of a Stop, Go, or Caution indicator lamps;

a lane visual alert member positioned downstream of said plurality of lane sensors and having at least one of a Stop, Go, or Caution indicator lamps;

wherein said controller is programmed to energize respective indicator lamps of said pedestrian visual alert member according to said proximity status data and said motion status data associated with said generated lane data;

wherein said controller is programmed to energize respective indicator lamps of said lane visual alert member according to said proximity status data and said direction of travel status data associated with said generated pedestrian data.

14. The pedestrian safety system as in claim 13, wherein:

said controller is programmed to determine, using data from said pair of downstream lane sensors, if an automobile is in motion downstream of the pickup window;

said controller is programmed to energize said Stop indicator lamp of said pedestrian visual alert member when said controller has determined that the automobile is in motion downstream of the pickup window;

said plurality of pedestrian sensors include an upstream lane sensor displaced from the pedestrian door and at least a pair of downstream pedestrian sensors arranged in a series downstream of the upstream pedestrian sensor;

said controller is programmed to determine, using data from said pair of downstream pedestrian sensors, if a pedestrian is in motion indicative of exiting the pedestrian door; and said controller is programmed to energize said Stop indicator lamp of said lane visual alert member when said controller has determined that the pedestrian is in motion indicative of exiting the pedestrian door.

15. The pedestrian safety system as in claim 14, wherein:

said controller is programmed to determine, using data from said upstream lane sensor, if an automobile is stopped adjacent said upstream lane sensor; and said controller is programmed to energize said Caution indicator lamp of said pedestrian visual alert member when said controller has determined that the automobile is stopped adjacent said upstream lane sensor;

said controller is programmed to determine, using data from said upstream pedestrian sensor, if a pedestrian is proximate said upstream pedestrian sensor; and said controller is programmed to energize said Caution indicator lamp of said lane visual alert member when said controller has determined that the pedestrian is adjacent said upstream pedestrian sensor.

16. The pedestrian safety system as in claim 14, wherein:

said controller is programmed to determine, using data from said upstream lane sensor and said pair of downstream lane sensors, if an automobile is stopped adjacent said upstream lane sensor and if another automobile is in motion downstream of said upstream sensor; and said controller is programmed to energize said Go indicator lamp of said pedestrian visual alert member when said controller has determined that no automobile is detected adjacent said upstream lane sensor and that no automobile is in motion downstream of said upstream sensor;

said controller is programmed to determine, using data from said upstream pedestrian sensor and said pair of downstream pedestrian sensors, if an pedestrian is adjacent said upstream pedestrian sensor and if another pedestrian is in motion downstream of said upstream pedestrian sensor; and said controller is programmed to energize said Go indicator lamp of said lane visual alert member when said controller has determined that no pedestrian is detected adjacent said upstream pedestrian sensor and that no pedestrian is in motion downstream of said upstream sensor.

17. A pedestrian safety method for a restaurant having a drive-through lane for an automobile, a pickup window situated along the drive-through lane, and a pedestrian door downstream of the pickup window, comprising:

generating lane data from a plurality of lane sensors positioned proximate the pickup window, said plurality of lane sensors including an upstream lane sensor adjacent an upstream end of the pickup window and at least a pair of downstream lane sensors arranged in a series downstream of the pickup window;

generating pedestrian traffic data from a plurality of pedestrian sensors positioned proximate the pedestrian door, said plurality of pedestrian sensors including a series of motion sensors;

determining, using said generated lane data, a proximity status and motion status associated with an automobile in the drive through lane;

determining, using said generated pedestrian data, a proximity and a direction of travel of a pedestrian proximate the pedestrian door of the restaurant;

providing a pedestrian visual alert member positioned proximate the pedestrian door of the restaurant and having at least one of a Stop, Go, or Caution indicator lamps;

providing a lane visual alert member positioned downstream of said plurality of lane sensors and having at least one of a Stop, Go, or Caution indicator lamps;

energizing respective indicator lamps of said pedestrian visual alert member according to the proximity status and motion status associated with the generated lane data; and energizing respective indicator lamps of said lane visual alert member according to the proximity status data and said direction of travel status data associated with said generated pedestrian data.

18. The pedestrian safety method as in claim 17, further comprising:

energizing said Stop indicator lamp of said pedestrian visual alert member upon determining that an automobile is in motion downstream of the pickup window; and energizing said Stop indicator lamp of said lane visual alert member upon determining that a pedestrian is in motion indicative of exiting the pedestrian door.

19. The pedestrian safety method as in claim 17, further comprising:

energizing said Caution indicator lamp of said lane visual alert member upon determining that the pedestrian is adjacent said upstream pedestrian sensor;

energizing said Caution indicator lamp of said pedestrian visual alert member upon determining that the automobile is adjacent said upstream lane sensor and no other automobile is in motion downstream of the upstream lane sensor.

20. The pedestrian safety method as in claim 17, further comprising:

energizing said Go indicator lamp of said lane visual alert member upon determining that the no pedestrian is adjacent said upstream pedestrian sensor or in motion indicative of exiting the pedestrian door;

energizing said Go indicator lamp of said pedestrian visual alert member upon determining that no automobile is adjacent said upstream lane sensor and no other automobile is in motion downstream of the upstream lane sensor.

21. The pedestrian safety system as in claim 1, further comprising:

a remote monitoring module displaced from the controller and that includes a remote receiver and a display, said remote monitoring module configured to receive and display at least one of said lane data, said proximity data, and said motion data determined by said controller.

22. The pedestrian safety system as in claim 1, further comprising a remote monitoring module displaced from the controller and that includes a remote receiver and a display; wherein:

said remote monitoring module is configured to receive and display at least one of said lane data, said proximity data associated with said lane data, and said motion data associated with said lane data determined by said controller;

said remote monitoring module is configured to receive and display at least one of said pedestrian data, said proximity data associated with said pedestrian data, and said direction of travel data associated with said pedestrian data determined by said controller.

* * * * *